United States Patent [19]

Vercruysse

[11] Patent Number: 4,514,133

[45] Date of Patent: Apr. 30, 1985

[54] DIE ENGAGING BLOCK FOR A DIE CHANGE TRUCK

[75] Inventor: Oscar D. Vercruysse, St. Clair Shores, Mich.

[73] Assignee: General Motors Corporation, Detroit, Mich.

[21] Appl. No.: 522,981

[22] Filed: Aug. 15, 1983

[51] Int. Cl.[3] ..... B66F 9/19

[52] U.S. Cl. ..... 414/512; 414/525 R; 414/661; 198/744; 198/746

[58] Field of Search ..... 414/259, 260, 277, 280, 414/345, 352, 353, 395, 398, 400, 499, 509, 512, 517, 525 R, 659, 661, 749, 750; 198/744, 746

[56] References Cited

U.S. PATENT DOCUMENTS 2,880,897 4/1959 Wilms et al. ..... 414/661

2,987,205 6/1961 Draxler ..... 414/497 X

*Primary Examiner*—Robert G. Sheridan

*Attorney, Agent, or Firm*—Patrick M. Griffin

[57] ABSTRACT

An improved die engaging means for a side loading die change truck includes a plurality of pusher-puller blocks pivoted along the length of the powered pusher bars and selectively engageable with the edge of a die to allow it to be easily moved in stages onto or off of a press bed. Each block may be rotated down to a stored position beneath the surface of the bar and beneath the surface of the die. An adaptor may be attached to each block to allow it to be used to pull a die, if desired.

2 Claims, 7 Drawing Figures

DIE ENGAGING BLOCK FOR A DIE CHANGE TRUCK

BACKGROUND OF THE INVENTION

With the increasing emphasis on productivity and flexibility of manufacturing operations, it has become more necessary to be able to quickly change the dies on a press line. A vehicle known as a die change truck, or simply as a die truck, is one means for speeding the die change process. The truck has a generally planar, horizontal die support bed which may be moved vertically up or down to the level of the press bed. Contained within slots in the bed are a pair of powered members or pusher bars which are moved toward and away from the press bed as hydraulic cylinders extend and retract, to either push a die toward a press bed or pull a die off a press bed. Clearly, some means is necessary for engaging the powered member with the die to be pushed or pulled.

Die change trucks are of two general types, front loading and side loading. In a front loading die truck, the die support bed is manuevered to a position flush with the press bed, and the die is pushed or pulled directly onto or off of the press bed. Clearly, in the front loading truck, the retracted powered members must be spaced back from the press bed a distance sufficient to allow the powered member to push the die onto the press bed in a single stroke or extension. If not, then it is clear that some additional spacing member would have to be interposed between the powered member and the die to obtain extra pushing length on a subsequent stroke. It is also clear that such a truck would have to be turned around in order to service presses located on the otherside of the truck.

Die trucks of the side loading type are designed to service presses in dual lines located on either side of the truck. In this type of truck, the powered member has a total length generally equal to the entire width of the die support bed, and will extend or retract in either direction out of the die support bed for only about half its length. The die support bed will have to be positioned level with, but spaced away from the press bed, because the powered members extend out to the press bed, and some other members, known as bridging members or bridging rails, will have to be interposed between the die support bed and the press bed to span the distance therebetween and provide a surface to move the die along. Also, the total stroke length available to either side of the press bed will unlikely be sufficient to move many dies onto or off of the press bed in a single stroke, and it will be necessary to retract the powered member, re-engage it with the die at a different point, and push or pull again in a subsequent stroke. Therefore, it is desirable that the means for engaging the powered member with the die be easily and quickly movable.

Prior art die engaging means consist generally of a heavy block with a pair of dowel pins which fit down into a line of holes spaced along the length of the powered member, known sometimes as a "pusher bar". The block engages an edge of the die to push it, or has a cable hooked around it in order to pull a die off of the press bed. These blocks must be physically pulled up out of the pin holes, and moved to different locations on the bar, an often difficult and time consuming task.

SUMMARY OF THE INVENTION

The subject invention provides an improved means for engaging the powered member of a side loading die truck with a die, a means which is an integral part thereof and which may be easily engaged and disengaged with the die at all relative positions of the die to speed the die changing process.

The die change truck, the bridging members and the means for moving the powered members are conventional. However, the die engaging means has a plurality of pusher-puller blocks pivoted to the powered member and spaced along its length, each pivotally movable from a stored position beneath the plane of the die support bed where it will not engage a die, and an operative position pivoted up above the plane of the die support bed where it may engage a die, either to push directly on an edge of the die or to be attached to a chain or cable to pull the die. The pusher-puller blocks are of two kinds or types. A first series includes stop blocks or latches which are engageable between them and the powered member to prevent counterclockwise rotation out of the operative or up position. This allows these first pusher-puller blocks to either pull a die from a press located on one side of the truck, or to push a die toward a press bed on the other side of the truck.

A second series of pusher-puller blocks is interspersed with the first along the length of the powered member, and includes stop members or latches engageable between them and the powered member to prevent them from rotating clockwise out of their operative or up position. This allows each pusher-puller block of the second series to either pull a die from a press located on the said other side of the truck, or to push a die toward a press on the said one side of the truck. All the pusher-puller blocks are easily pivotable manually into and out of operative position, and the stop members and latch means may be easily engaged and disengaged. Thus, the die may be easily engaged, disengaged and re-engaged with the powered member as the powered member moves in subsequent strokes to move the die toward or away from a press bed in successive stages. The plurality of pusher-puller blocks spaced along the length of the powered member provides for a pusher-puller block convenient to essentially any relative position of the die and the powered member. The process of moving a die in successive stages to either side of the truck bed is thereby made simpler and quicker.

It is, therefore, a broad object of the invention to provide a side loading die change truck in which dies may be pushed or pulled to either side of the truck more easily and rapidly.

It is a more specific object of the invention to provide such a die change truck which includes an improved means on a powered member for engaging, disengaging and re-engaging the powered member with the die to be changed in order to facilitate the process of moving the die in successive stages with successive strokes of the powered member.

It is a still more specific object of the invention to provide such a powered member which includes puller-pusher blocks pivoted thereto along its length which may be easily pivoted up and down between stored and operative positions at any relative position of the die and the powered member to allow the die to be quickly and easily engaged, disengaged and re-engaged as it is moved in successive stages along a bridging member between the truck bed and the press bed.

BRIEF DESCRIPTION OF THE DRAWINGS

These and other objects of the invention will appear from the following written description of the drawings in which.

DESCRIPTION OF THE PREFERRED EMBODIMENT

Figure 1:
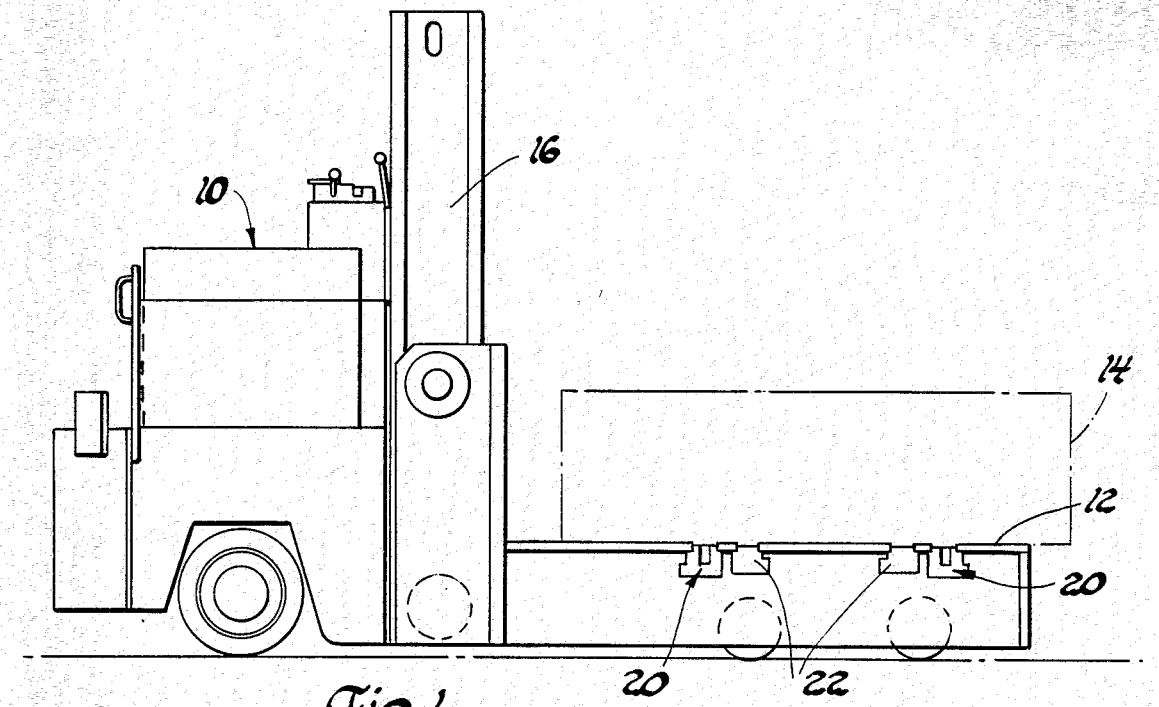
FIG. 1 is a side view of a die change truck with a die indicated generally in dotted lines supported on the support bed thereof.

Referring first to FIG. 1, a conventional side loading die change truck is indicated generally at 10 and includes a planar, horizontal die support bed 12 upon which a die indicated at 14 in dotted lines is supported. Bed 12 may be moved up and down by a suitable power means along vertical rails 16 to a position where it is level with the bed of a press to be serviced. Die change trucks similar to 10 are widely commercially available and will not be further described.

Figure 2:
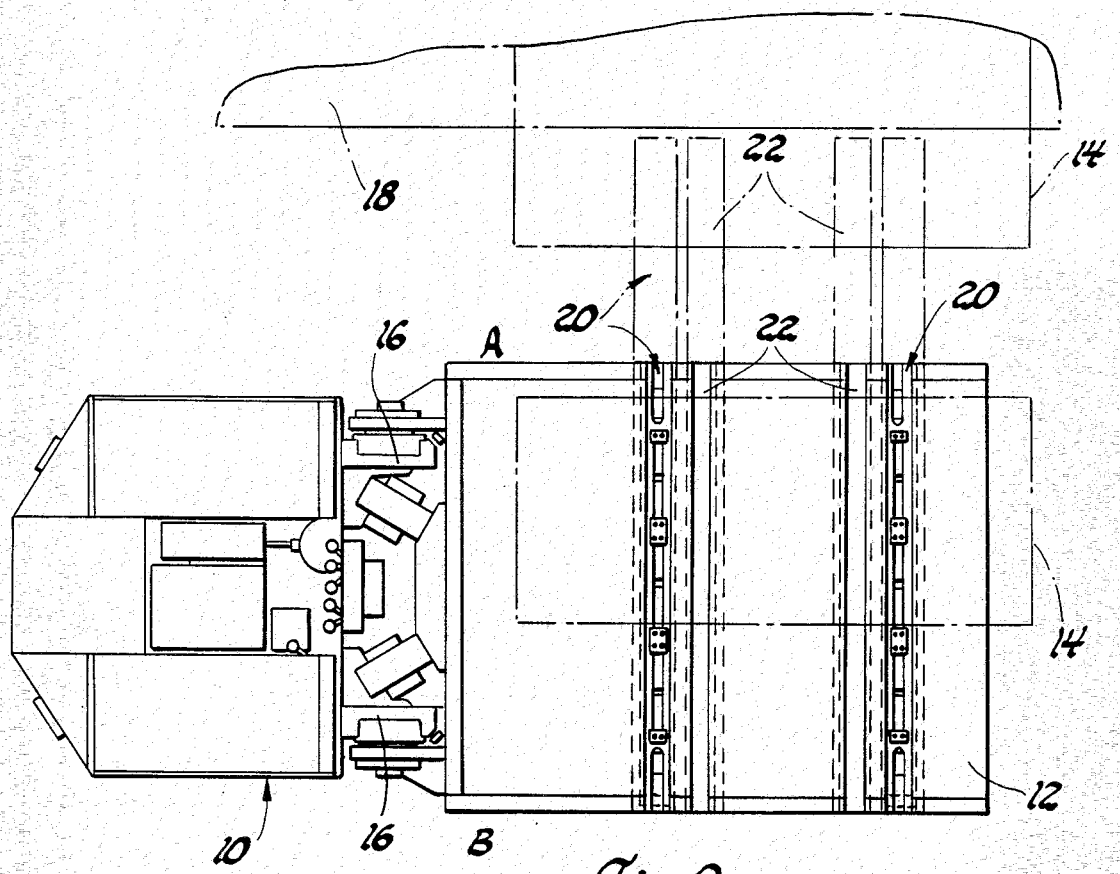
FIG. 2 is a plan view of the die change truck of FIG. 1 and showing a press bed with a die shown generally in dotted lines at two successive stages of movement.

Referring now to FIG. 2, truck 10 is shown servicing a press 18 which is on a side thereof designated arbitrarily as "A". A press on the other or "B" side may also be serviced by the side loading truck without turning it around, as opposed to the front loading truck described above. Die 14 is moved by a pair of powered members, designated generally at 20, often referred to as thrust bars or pusher bars, although they are used to pull a die as well. As may be seen in FIG. 2, powered members 20 have a length substantially equal to the width of support bed 12, and, as may be seen in FIG. 1, they reside within coextensive slots in support bed 12 located just beneath the planar surface thereof so as to clear a die 14 resting thereon. This coextensive length is necessary so that presses may be served to either side of truck 10. It is impossible to position support bed 12 flush with the bed of a press 18, so a pair of bridging members or rails 22 must be used. Bridging rails 22 are contained within coextensive slots in bed 12 parallel to and to the inside of powered members 20, and act as guiding supports for die 14 running from bed 12 to press 18. Bridging rails 22 are also power operated, but this is a matter of convenience as they act as no more than support surfaces, and do not move die 14 themselves.

Figure 3:
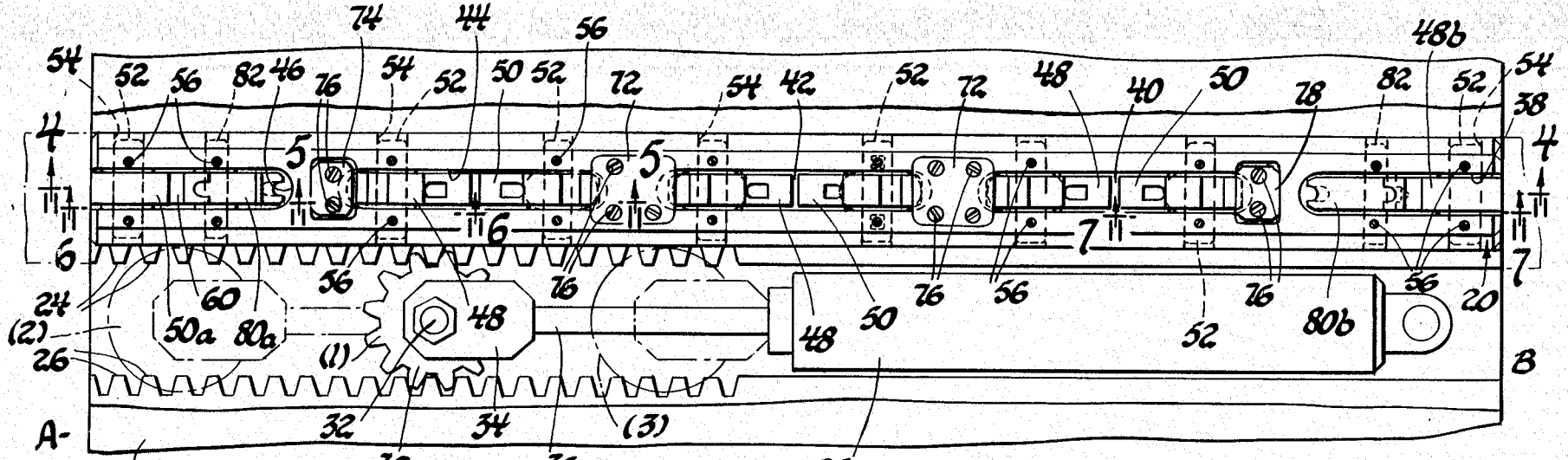
FIG. 3 is a fragmentary enlarged plan view of the die truck support bed showing one of the powered members incorporating the die engaging means of the invention.

Referring now to FIG. 3, more details of the operation of powered member 20 may be understood. Powered member 20 is a substantially heavy and strong bar of alloy steel and includes a series of gear teeth 24 cut into or rigidly attached to one side thereof over approximately half of its length. These are matched by opposing gear teeth 26 on the side of the slot within the bed 12. Powered member 20 is moved by a hydraulic cylinder 28 located within and beneath the planar surface of bed 12 which has a power stroke of approximately helf the length of powered member 20. A toothed wheel 30 is pivoted at 32 to a clevis member 34 on the end of piston rod 36. Wheel 30 rests normally at indicated position (1), approximately at the midpoint of the opposed gear teeth 24 and 26. As rod 36 extends to the indicated position (2), an approximately 2:1 multiplication effect will move powered member 20 in the "A" direction for approximately half its length. Similarly, as rod 36 retracts, wheel 30 moves to the indicated position (3) which will move powered member 20 in the "B" direction for approximately half its length. While this creates the capability of servicing the press on either side of truck 10, the price paid is the relatively short stroke of the powered member 20 and the necessity of moving die 14 in successive stages, a process which is significantly speeded by the invention more fully described below.

Figure 4:
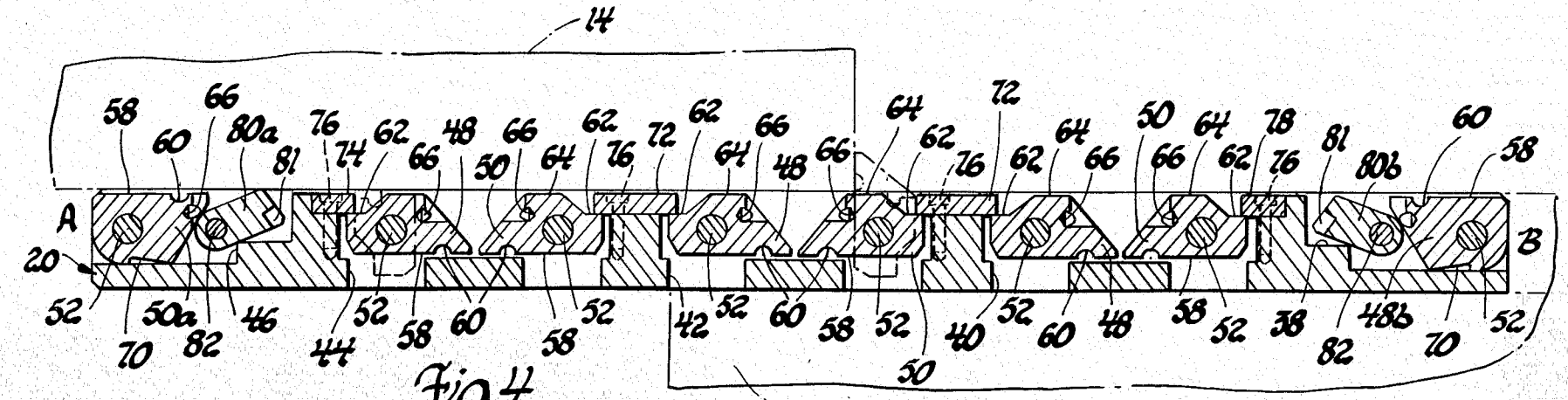
FIG. 4 is a sectional view along line 4—4 of FIG. 3 and showing the truck support bed and the die to be moved in dotted lines.
Figure 5:
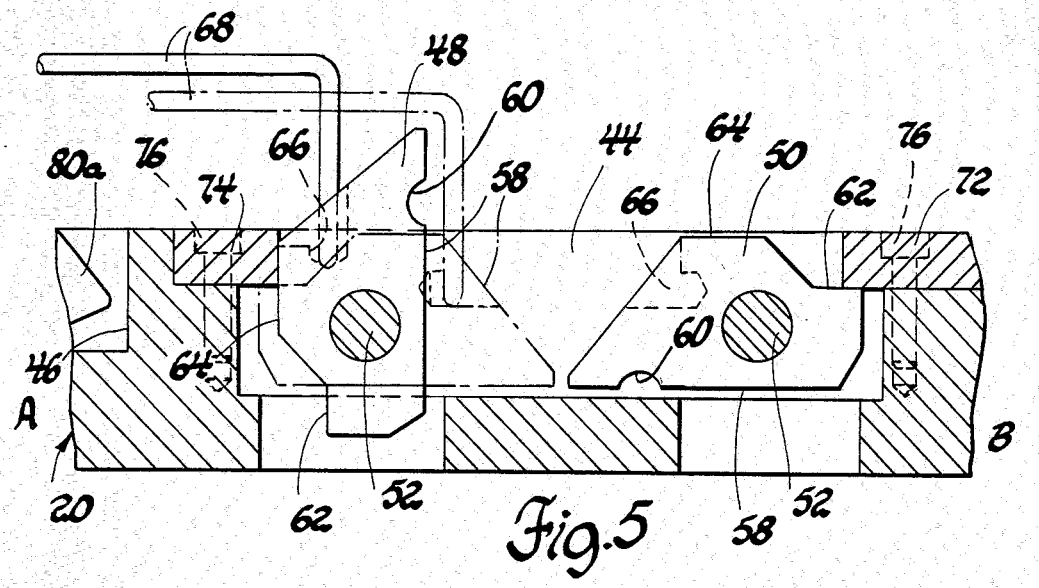
FIG. 5 is a sectional view taken along the line 5—5 of FIG. 3 showing a pusher-puller block of the invention in both its stored and operative positions.
Figure 6:
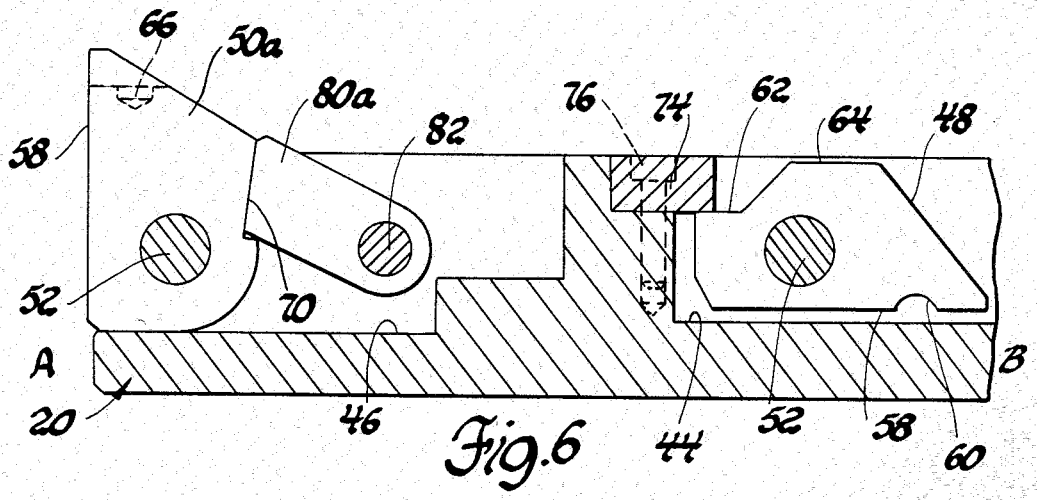
FIG. 6 is a sectional view taken along the line 6—6 of FIG. 3 showing one end of the powered member.

Clearly, a means will be necessary for engaging the die with the powered member to move it, be that directly by pushing on an edge of the die, or indirectly by pulling on a cable or chain which is attached to the die. The structure of the invention which accomplishes this purpose may be seen in FIGS. 4–7. Referring first to FIG. 4, powered member 20 has a series of five pockets, numbered 38, 40, 42, 44 and 46, machined into it, best visible in FIG. 3. Pockets 38–46 are machined so as to remove just enough steel to allow a plurality of first, 48, and second, 50, pusher-puller blocks to be contained therein and pivoted to powered member 20 on pins 52, which, as may be seen best in FIG. 3, sit in holes drilled across each pocket 38–46 and held in position by screws 56.

As may be seen best in FIG. 4, both the first and second pusher-puller blocks 48 and 50 have an identical shape, apart from those mounted to each end which are separately numbered **48*b* and 50*a*, respectively, to distinguish them. Every block 48 and 50 has a generally flat, die engaging surface 58 with a C-sectioned groove 60 cut all the way across near the top thereof, for a purpose described below. All of the interior blocks 48 and 50 include, on the side opposite the engaging surface 58, a pair of offset stop surfaces 62 and 64. The top of each interior block 48, 50 is cut off at an angle and has a hook hole 66 machined thereinto, to allow them to be moved by hooks 68 (FIG. 5), described below. The endmost blocks 48*b* and 50*a* are identical to one another, but pivotally mounted on pins 52 opposite to one another, and include the same structure as the interior blocks 48 and 50, except for the stop surfaces 62 and 64. Instead, each block 48*b* and 50*a* has a notch 70 cut into the side opposite die engaging surface 58**, for a purpose to be described below.

Referring to FIG. 4, the interior first blocks 48 and second blocks 50 are mounted in three oppositely rotating pairs within the pockets 40, 42 and 44. The first blocks 48 all pivot in a counterclockwise direction up from their position in FIG. 4, which may be referred to as the "stored" position beneath the surface of bed 12, to what may be referred to as an "operative" position, shown in FIG. 5. The end-most second block **50*a* rotates oppositely from its stored position of FIG. 4, counterclockwise up to the operative position of FIG. 6. Likewise, the end-most first block 48*b* rotates oppositely from the interior blocks 48, clockwise up to a stored position, which is not shown. Other means may be imagined for mounting blocks 48 and 50. What is important and advantageous is that they be effectively integral with powered member 20**, and be easily movable between stored and operative position.

What distinguishes all the first blocks 48 and 48*b*, from all the second blocks 50 and 50*a* are stop means which prevent their movement out of operative position and back to stored position when acting to push a die in one direction or pull a die in the other direction. In the embodiment disclosed, the stop means prevent rotation of the blocks out of operative position in a certain direction. For example, all of first blocks 48 and 48*b* are prevented from rotating counterclockwise out of their operative positions by a first stop means, which, for the interior-most blocks 48 comprises simply one side of a stop block, an inner two blocks referred to at 72 and a smaller stop block 74 near the A-end of powered member 20. Blocks 72 and 74 are rectangular plates, best seen in FIG. 3, attached by screws 76 between the pockets 40–44 flush with the top of powered member 20. Thus, for both of the interior first blocks 48, when in the operative position of FIG. 5, stop surface 64 will engage the side of a block, either 72 or 74, to prevent counterclockwise rotation out of that operative position. Conversely, in the stored position, stop surface 62 will engage the under surface of the stop block 72 or 74.

Figure 7:
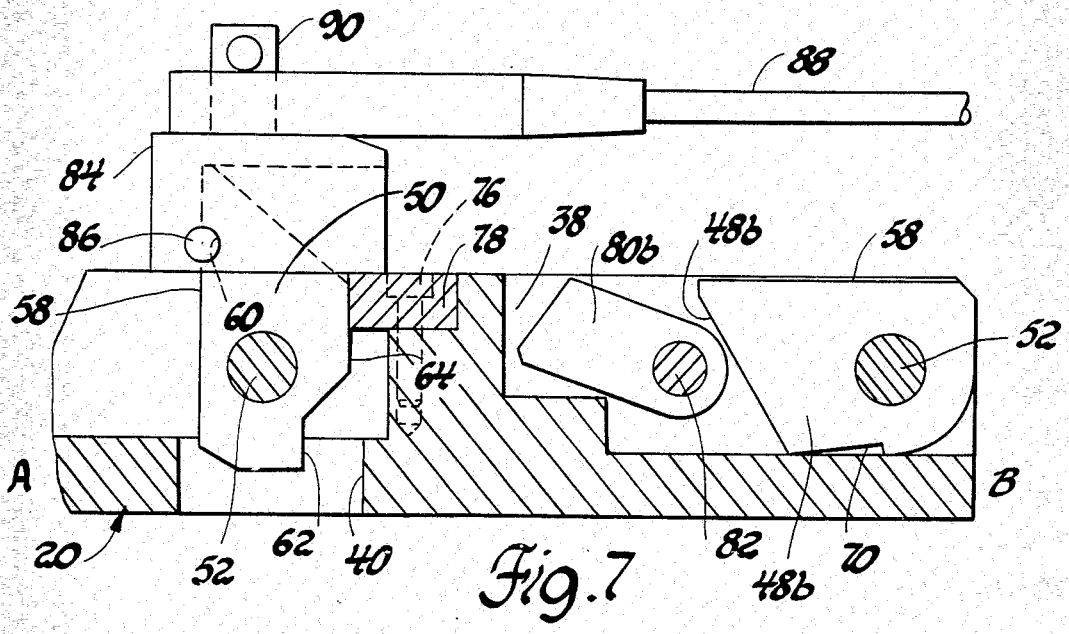
FIG. 7 is a sectional view taken along the line 7—7 of FIG. 3 showing the other end of the powered member.

Likewise, for the two interior second blocks 50, the operative position seen in FIG. 4 or in FIG. 7 will engage stop surface 64 with another side of either stop blocks 72 or another stop block 78 identical to stop block 74, but near the B-end of powered member 20, preventing clockwise rotation out of the operative position. And, similarly, their IO stored positions will bring stop surfaces 62 into engagement with the under surfaces of stop blocks 72 or 78. The end-most respective first and second blocks 48*b* and 50*a*, however, require a different type of stop means, comprising a latch 80*b* and 80*a* respectively, each of which is rotatable on a pin 82 from a stored position seen in FIG. 4 to an engaged position seen, visible for block 50*a* in FIG. 6, set into notch 70 to maintain second block 50*a* from rotating clockwise out of its operative position. The operation is identical for first block 48*b*, though not shown. Each latch 80*b* and 80*a* also includes hook hole 81, best seen in FIG. 4.

The clockwise and counterclockwise stop means, and the interspersal of the first and second pusher-puller blocks, allows die 14 to be more efficiently moved in stages, as next described. Referring again to FIG. 1, as the die 14 rests upon support bed 12, its edge will be near some pusher-puller block 48 or 50 on each of the powered members 20. As shown, it is near one of the interior second blocks 50. Using hook member 68, visible in FIG. 5, inserted into hook hole 66, block 50 may be easily pivoted up to its operative position with stop surface 64 engaged with one side of stop block 74. Then, powered member 20 may be extended, pushing die 14 to the end of its stroke, retracted, block 50 flipped back down to stored position and another block 50 flipped up, possibly end-most block 50*a*, to engage die 14 to push it over another stroke of powered member 20. Hook member 68 can also be inserted into hook hole 81 to flip up either latch 80*b* or 80*a*.

This process is simply reversed for pulling a die from the press 18 located on the "B" side of truck 10. In the pulling operation, as seen in FIG. 7, an adaptor cap 84 is designed to fit over block 50 with a rod 86 welded to the interior which fits into C-sectioned groove 60. A cable 88 fits onto a pin 90 on the top of cap 84 and onto a hook, pin, or other attachment device on the edge of die 14, not shown. Then, die 14 is simply pulled in successive stages similarly to the way in which it was pushed in successive stages toward the "A" side. Thus, it will be understood that each series of first blocks 48 may be used to pull a die from the "A" side of the truck or to push a die toward the "B" side of the truck, while each of the series of second blocks 50 may be used to pull a die from the "B" side of truck 10 or to push a die toward the "A" side of truck 10. The interspersing of the two series of blocks provides a block convenient to any relative position of the die and powered member 20, and the ease of manual movement from stored to operative positions speeds up the operation of moving the die in successive stages.

The embodiments of the invention in which an exclusive property or privilege is claimed are defined as follows:

1. In a die change truck or the like of the type having a substantially planar, horizontal bed for supporting a die to be pulled from or pushed onto the bed of a press located to either side of the truck bed, and having at least one elongated powered member extendible and retractible relative to either side of the truck bed with a stroke less than the width of a die to be changed so that the die must be moved by the powered member in successive stroke stages, an improved means for selectively engaging and disengaging the powered member with the die comprising:

a plurality of first pusher-puller blocks spaced along the length of the powered member and mounted thereto for movement between a stored position not above the plane of the truck bed and an operative position extending above the plane to engage a die, a plurality of second pusher-puller blocks spaced along the length of the powered member and interspersed with the first blocks and mounted to the powered member for movement between a stored position not above the plane of the truck bed and an operative position extending above the plane to engage a die, first stop means engageable between each first pusher-puller block and the powered member to prevent movement out of the operative position so that each first block in its operative position may pull a die from a press bed on one side of the truck bed or push a die toward a press bed on the other side of the truck bed, and second stop means engageable between each second pusher-puller block and the powered member to prevent movement out of the operative position, so that each second block in its operative position may pull a die from a press bed on the said other side of the truck bed or push a die toward a press bed on the said one side of the truck bed, the first and second stop means being disengageable from its respective block to allow free rotation of said blocks back to stored position, the cooperation of a selected one of said plurality of interspersed first and second pusher-puller blocks with a respective one of said first and second stop means providing a rapid means for engaging, disengaging and re-engaging a die with the powered member at any given relative position of the die and the powered member as the powered member extends or retracts so that the die may be more quickly changed.

2. In a die change truck or the like of the type having a substantially planar, horizontal bed for supporting a die to be pulled from or pushed onto the bed of a press located to either side of the truck bed, and having at least one coplanar bridging member running from the truck bed to the press bed and at least one elongated powered member extendible and retractible relative to the bridging member with a stroke less than the width of a die to be changed so that the die must be pushed or pulled along the bridging member by the powered member in successive stroke stages, an improved means for selectively engaging and disengaging the powered member with the die comprising:

a plurality of first pusher-puller blocks spaced along the length of the powered member and pivoted thereto for rotation between a stored position not above the plane of the truck bed and an operative position extending above the plane to engage a die, a plurality of second pusher-puller blocks spaced along the length of the powered member and interspersed with the first blocks and pivoted to the powered member for rotation between a stored position not above the plane of the truck bed and an operative position extending above the plane to engage a die, first stop means engageable between each first pusher-puller block and the powered member to prevent counterclockwise rotation out of the operative position, whereby each first block in its operative position may pull a die from a press bed on one side of the truck bed or push a die toward a press bed on the other side of the truck bed, and second stop means engageable between each second pusher-puller block and the powered member to prevent clockwise rotation out of the operative position, whereby each second block in its operative position may pull a die from a press bed on the said other side of the truck bed or push a die toward a press bed on the said one side of the truck bed, the first and second stop means being disengageable from its respective block to allow free rotation of said blocks back to stored position, the cooperation of a selected one of said plurality of interspersed first and second pusher-puller blocks with a respective one of said first and second stop means providing a rapid means for engaging, disengaging and re-engaging a die with the powered member at any given relative position of the die and the powered member as the powered member extends or retracts so that the die may be more quickly changed.

* * * * *